US009097156B2

(12) United States Patent
Nagata et al.

(10) Patent No.: US 9,097,156 B2
(45) Date of Patent: Aug. 4, 2015

(54) EXHAUST GAS PURIFYING DEVICE

(75) Inventors: Yoshinobu Nagata, Okazaki (JP); Masafumi Wada, Okazaki (JP); Tatsutoshi Osaki, Okazaki (JP)

(73) Assignee: FUTABA INDUSTRIAL CO., LTD., Okazaki-shi, Aichi (JP)

( * ) Notice: Subject to any disclaimer, the term of this patent is extended or adjusted under 35 U.S.C. 154(b) by 0 days.

(21) Appl. No.: 14/002,205

(22) PCT Filed: Mar. 1, 2012

(86) PCT No.: PCT/JP2012/055246

§ 371 (c)(1),
(2), (4) Date: Aug. 29, 2013

(87) PCT Pub. No.: WO2012/118149

PCT Pub. Date: Sep. 7, 2012

(65) Prior Publication Data

US 2013/0333357 A1 Dec. 19, 2013

(30) Foreign Application Priority Data

Mar. 2, 2011 (JP) ..... 2011-045322

(51) Int. Cl.
*F01N 3/24* (2006.01)
*F01N 3/08* (2006.01)
(Continued)

(52) U.S. Cl.
CPC *F01N 3/08* (2013.01); *F01N 13/08* (2013.01); *F01N 13/185* (2013.01);
(Continued)

(58) Field of Classification Search
CPC ..... F01N 2470/18; F01N 2470/02
USPC ..... 60/296, 297, 299, 311
See application file for complete search history.

(56) References Cited

U.S. PATENT DOCUMENTS 6,241,044 B1 * 6/2001 Nishiyama et al. ..... 181/272
2003/0051449 A1 * 3/2003 Nishiyama et al. ..... 55/309
(Continued)

FOREIGN PATENT DOCUMENTS

EP 2287453 A1 2/2011
EP 2345802 A2 7/2011
(Continued)

OTHER PUBLICATIONS

Translation of the International Report on Patentability including Written Opinion of the International Search Authority (including Form PCT/IB/338, Form PCT/IB/373, and Form PCT/ISA/237 (English translation)) corresponding to International Patent Application No. PCT/JP2012/055246 dated Sep. 12, 2013.
(Continued)

*Primary Examiner* — Thomas Denion
*Assistant Examiner* — Jorge Leon, Jr.
(74) *Attorney, Agent, or Firm* — Jenkins, Wilson Taylor & Hunt, P.A.

(57) ABSTRACT

An exhaust gas purifying device includes a cylindrical shell, a flow channel pipe, and a lid member. The pipe is connected to the shell along a radial direction of the shell. The shell is a member that is formed in a cylindrical shape having a pair of open ends, and in which exhaust gases flow. The shell has at least one shell-side fitting groove that is formed at one of the ends, and in which the pipe is fittable. The lid member is a member that closes the one of the pair of ends of the shell, and has at least one lid-side fitting groove that is formed at a position facing the at least one shell-side fitting groove, and in which the pipe is fittable. The at least one shell-side fitting groove and the at least one lid-side fitting groove fit the pipe therein by holding the pipe therebetween.

7 Claims, 5 Drawing Sheets

(51) Int. Cl.

| | |
|---|---|
| ***F01N 13/08*** | (2010.01) |
| ***F01N 13/18*** | (2010.01) |
| *F01N 3/28* | (2006.01) |
| *F01N 3/021* | (2006.01) |

(52) U.S. Cl.

CPC ..... *F01N 13/1872* (2013.01); *F01N 13/1888* (2013.01); *F01N 3/021* (2013.01); *F01N 3/2892* (2013.01); *F01N 2330/36* (2013.01); *F01N 2450/00* (2013.01); *F01N 2470/00* (2013.01); *F01N 2470/02* (2013.01); *F01N 2470/18* (2013.01)

(56) References Cited

U.S. PATENT DOCUMENTS

| | | | | |
|---|---|---|---|---|
| 2007/0039316 | A1* | 2/2007 | Bosanec et al. | 60/299 |
| 2008/0264048 | A1* | 10/2008 | Nishiyama et al. | 60/299 |
| 2008/0307780 | A1* | 12/2008 | Iverson et al. | 60/311 |
| 2009/0260351 | A1 | 10/2009 | Cremeens et al. | |
| 2010/0107612 | A1* | 5/2010 | Yamazaki et al. | 60/295 |
| 2010/0107613 | A1* | 5/2010 | Masuda et al. | 60/297 |
| 2011/0023472 | A1* | 2/2011 | Saito et al. | 60/311 |
| 2011/0047963 | A1* | 3/2011 | Kasaoka et al. | 60/272 |
| 2011/0120104 | A1* | 5/2011 | Masuda et al. | 60/311 |
| 2011/0138794 | A1* | 6/2011 | Yamamoto | 60/311 |
| 2011/0167807 | A1* | 7/2011 | Mitsuda | 60/311 |
| 2011/0167808 | A1* | 7/2011 | Kosaka et al. | 60/311 |

FOREIGN PATENT DOCUMENTS

| | | | |
|---|---|---|---|
| JP | 2003/120277 | | 4/2003 |
| JP | 2005/016374 | A | 1/2005 |
| JP | 2008267225 | A | 11/2008 |
| JP | 2009047016 | A | 3/2009 |
| JP | 2009097435 | A | 5/2009 |
| JP | 5054817 | B2 | 10/2012 |

OTHER PUBLICATIONS

International Search Report (Form PCT/ISA/410) corresponding to International Patent Application No. PCT/JP2012/055246 dated May 22, 2012.

Extended European Search Report for Application No. 12752436.1 dated Jan. 29, 2015.

Chinese Office Action for Application No. 2012/80010518.2 dated Feb. 13, 2015.

Japanese Office Action for Application No. 2011/045322 dated Nov. 11, 2014.

* cited by examiner

-- RELATED ART --

EXHAUST GAS PURIFYING DEVICE

CROSS-REFERENCE TO RELATED APPLICATIONS

This application is filed under the provisions of 35 U.S.C. 371 and claims the priority of International Patent Application No. PCT/JP2012/055246 filed on Mar. 1, 2012, and of Japanese Patent Application No. 2011-045322 filed on Mar. 2, 2011—in the Japan Patent Office. The entire disclosure of Japanese Patent Application No. 2011-045322 is incorporated by reference herein.

TECHNICAL FIELD

The present invention relates to an exhaust gas purifying device that purifies exhaust gases from an internal combustion engine.

BACKGROUND ART

Conventionally, as described in Patent Document 1, an exhaust gas purifying device is known that purifies exhaust gases by a catalyst incorporated in an exhaust gas flow channel of an internal combustion engine, such as a gasoline engine and a diesel engine, or by spraying urea into the exhaust gas flow channel. In this type of exhaust gas purifying device, a filter, a catalyst, etc. are contained in a cylindrical shell, and a flow channel pipe inserted in the cylindrical shell from a radial direction of the cylindrical shell is connected to the exhaust gas flow channel, to form a flow channel through which exhaust gases pass.

As shown in FIG. 5, a cylindrical shell 50 is a member formed in a cylindrical shape as a whole, and a pair of through holes 52, 54 are formed on a same axis along a radial direction of the cylindrical shell 50. A flow channel pipe 56 formed in a cylindrical shape is inserted through these through holes 52, 54.

An opening at one end of the cylindrical shell 50 is closed by attachment thereto of a lid member 58. The attachment of the lid member 58 is made by bending a periphery of the lid member 58 toward the cylindrical shell 50 to be fitted onto the cylindrical shell 50.

PRIOR ART DOCUMENTS

Patent Documents

Patent Document 1: Japanese Unexamined Patent Application Publication No. 2008-267225

SUMMARY OF THE INVENTION

Problems to be Solved by the Invention

The exhaust gas purifying device as described in Patent Document 1, therefore, has a problem in that a length $L_a$ in an axial direction from the flow channel pipe 56 to the lid member 58 becomes long, thus increasing the size of the device.

That is to say, a conventional exhaust gas purifying device has a problem in that the length of the cylindrical shell in its axial direction becomes long, thus increasing the size of the device.

An object of the present invention is to provide a miniaturized exhaust gas purifying device.

Means for Solving the Problems

The present invention made to achieve the above object relates to an exhaust gas purifying device to be connected to an exhaust gas flow channel of an internal combustion engine to purify exhaust gases flowing in the exhaust gas flow channel.

An exhaust gas purifying device of the present invention includes: a cylindrical shell that is formed in a cylindrical shape having a pair of open ends, and in which the exhaust gases flow; a flow channel pipe that is connected to the cylindrical shell along a radial direction of the cylindrical shell; and a lid member that closes one end of the pair of ends of the cylindrical shell.

The cylindrical shell has at least one shell-side fitting groove that is formed at the one end, and in which the flow channel pipe is fittable. The lid member has at least one lid-side fitting groove that is formed at a position facing the at least one shell-side fitting groove, and in which the flow channel pipe is fittable.

In the exhaust gas purifying device of the present invention, the at least one shell-side fitting groove and the at least one lid-side fitting groove may fit the flow channel pipe therein by holding the flow channel pipe therebetween.

Moreover, in the exhaust gas purifying device of the present invention, the cylindrical shell and the lid member may have bent-back portions obtained by raising the cylindrical shell and the lid member along the respective fitting grooves.

Also, in the exhaust gas purifying device of the present invention, a pair of shell-side fitting grooves may be provided, and a pair of lid-side fitting grooves may be provided. In addition, the pair of shell-side fitting grooves may be formed on a same axis, and the pair of lid side fitting grooves may be formed on a same axis.

Furthermore, the flow channel pipe in the exhaust gas purifying device of the present invention may be provided in a periphery thereof with at least one through hole, with one end of the flow channel pipe being closed.

Moreover, the flow channel pipe in the exhaust gas purifying device of the present invention may be a cylindrical member with both ends open, with one of the ends of the flow channel pipe being located inside the cylindrical shell.

Effects of the Invention

The exhaust gas purifying device of the present invention is configured to hold the flow channel pipe between the cylindrical shell and the lid member. This configuration brings an effect of reducing the length in an axial direction from the flow channel pipe to the lid member, thus miniaturizing the device.

EXPLANATION OF REFERENCE NUMERALS

1 . . . exhaust gas purifying device, 6 . . . oxidation catalyst, 8 . . . DPF, 10 . . . container, 12, 16, 50 . . . cylindrical shell, 14, 14*a*, 56 . . . flow channel pipe, 18, 18*a*, 58 . . . lid member, 20,

22 . . . shell-side fitting groove, 24, 26, 44, 46 . . . bent-back portion, 28 . . . flange member, 30 . . . through hole, 34 . . . cap member, 36 . . . fitting portion, 40, 42 . . . lid-side fitting groove, 100 . . . internal combustion engine

MODE FOR CARRYING OUT THE INVENTION

Hereinafter, an embodiment for carrying out the present invention will be described in detail with reference to the drawings.

Figure 1:
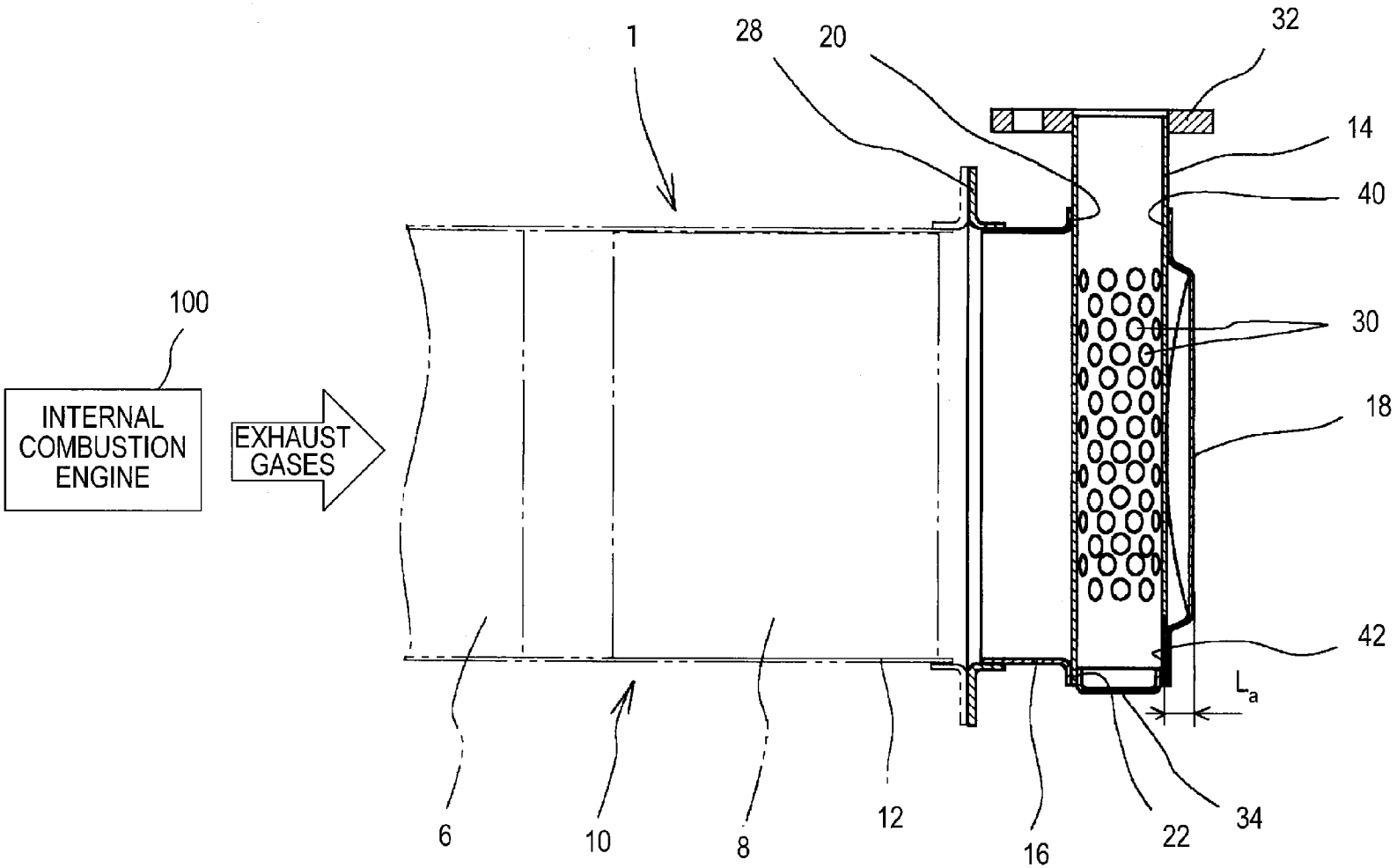
FIG. 1 is a main-part sectional view of an exhaust gas purifying device in an embodiment.

As shown in FIG. 1, an exhaust gas purifying device 1 is disposed in an exhaust gas flow channel (not shown) in which exhaust gases from an internal combustion engine 100 flow, and includes, for example, an oxidation catalyst 6, a diesel particulate filter (hereinafter referred to as DPF) 8, and a container 10. The oxidation catalyst 6 and the DPF 8 are contained in the container 10.

The oxidation catalyst 6 changes, in the exhaust gases, hydrocarbons into carbon dioxide and water, and carbon monoxide by oxidation into carbon dioxide. Also, the oxidation catalyst 6 is a well-known oxidation catalyst that changes nitrogen monoxide from among the nitrogen oxides in the exhaust gases into nitrogen dioxide. The DPF 8 is a well-known DPF that captures and burns soot in the exhaust gases.

In the present embodiment, the container 10 includes: a cylindrical shell 12 that contains the oxidation catalyst 6 and the DPF 8; and a cylindrical shell 16 that is flange connected to the cylindrical shell 12, and is provided with a flow channel pipe 14. One end of the cylindrical shell 16 is closed by attachment thereto of a lid member 18. The exhaust gases flowing into the exhaust gas flow channel pass through the oxidation catalyst 6 and then through the DPF 8, and flow out into the exhaust gas flow channel on a downstream side via the flow channel pipe 14.

Although the present embodiment describes a case where both of the oxidation catalyst 6 and the DPF 8 are contained in the container 10, only one of the oxidation catalyst 6 and the DPF 8 may be contained in the container 10 in the present invention. Furthermore, although the present embodiment describes a case where the flow channel pipe 14, the cylindrical shell 16, and the lid member 18 are provided at an exhaust gas outflow end of the cylindrical shell 12, the locations for the flow channel pipe 14, the cylindrical shell 16, and the lid member 18 are not limited thereto, and the flow channel pipe 14, the cylindrical shell 16, and the lid member 18 may be provided, in the same manner, at an exhaust gas inflow end of the cylindrical shell 12.

Figure 2:
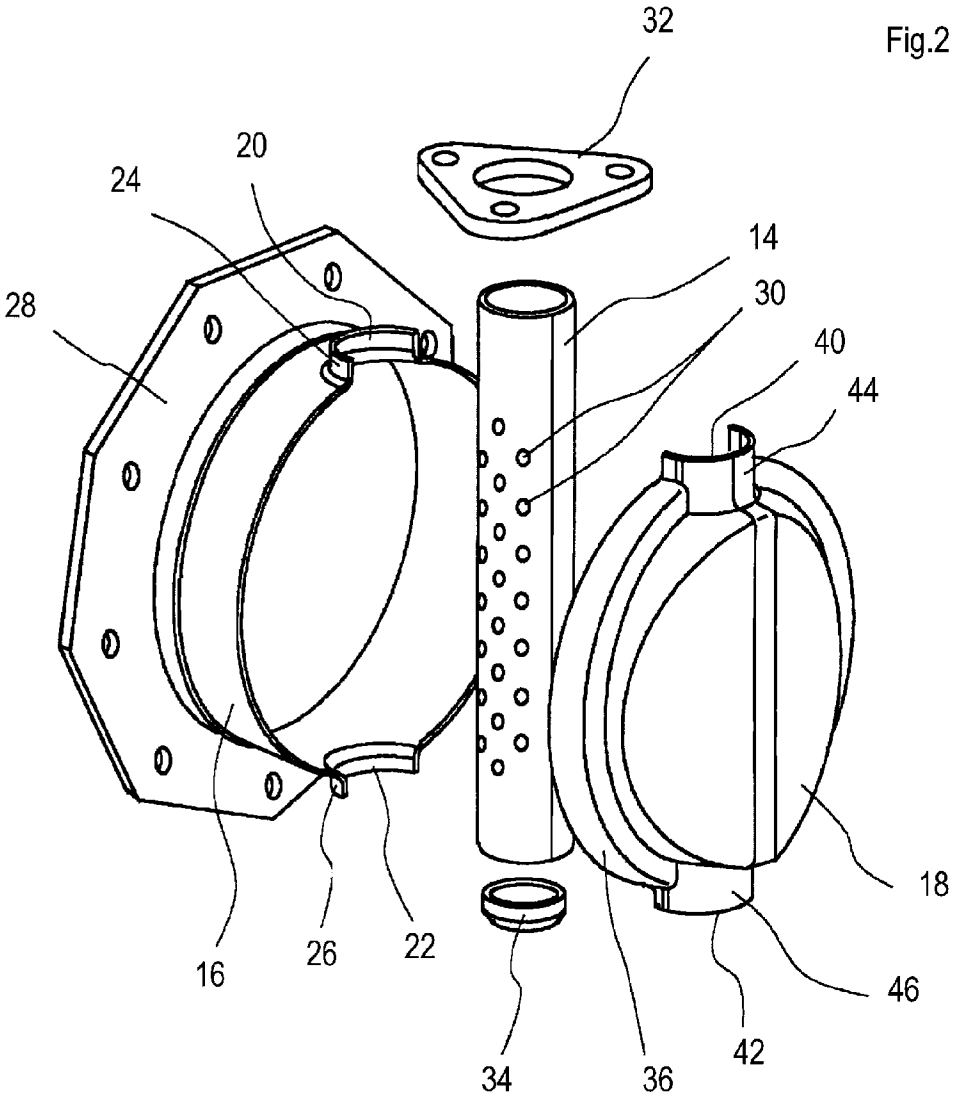
FIG. 2 is a main-part exploded perspective view of the exhaust gas purifying device in the embodiment.

As shown in FIG. 2, the cylindrical shell 16 to be furnished with the flow channel pipe 14 is provided at the one end thereof with a pair of shell-side fitting grooves 20, 22. The pair of shell-side fitting grooves 20, 22 are constituted by bent-back portions 24, 26 obtained by forming depressions in a wall of the cylindrical shell 16 and bending back the wall of the cylindrical shell 16 along the depressions.

Each of the pair of bent-back portions 24, 26 protrudes outward from the cylindrical shell 16 in a radial direction of the cylindrical shell 16. Also, the pair of shell-side fitting grooves 20, 22 are formed on a same axis.

The pair of shell-side fitting grooves 20, 22 are formed in such size and shape as to allow the flow channel pipe 14 to fit therein. In the present embodiment, each of the shell-side fitting grooves 20, 22 is formed in a semicircular shape to allow approximately half of the periphery of the flow channel pipe 14 having a cylindrical shape to fit therein. The bent-back portions 24, 26 also are formed to have semicircular cross sections.

At the other end of the cylindrical shell 16 is attached a flange member 28 for flange connection with the cylindrical shell 12. Although the container 10 of the present embodiment is constituted by a plurality of the cylindrical shell 12 and the cylindrical shell 16, i.e., the two cylindrical shells 12, 16, the container 10 may be constituted by a single cylindrical shell.

The flow channel pipe 14 of the present embodiment is formed to be longer in length than a diameter of the cylindrical shell 16. Furthermore, a large number of through holes 30 are provided in a portion of the flow channel pipe 14 that is to be located inside the cylindrical shell 16 when the flow channel pipe 14 is fitted in the shell-side fitting grooves 20, 22.

Moreover, at one end of the flow channel pipe 14 protruding outward from the cylindrical shell 16 is attached a flange member 32 for flange connection with an exhaust pipe constituting the exhaust gas flow channel on a downstream side. A cap member 34 to close the other end of the flow channel pipe 14 is fitted in the other end of the flow channel pipe 14.

The lid member 18 is formed in a disc shape so as to fit around an outer periphery of the one end of the cylindrical shell 16. In a periphery of the lid member 18 is formed a fitting portion 36 that is bent toward the cylindrical shell 16 along the periphery. The fitting portion 36 is formed to be fittable around the outer periphery of the cylindrical shell 16.

The lid member 18 is provided with a pair of lid-side fitting grooves 40, 42 that face the shell-side fitting grooves 20, 22. The pair of lid-side fitting grooves 40, 42 are constituted by bent-back portions 44, 46 obtained by forming depressions in a wall of the fitting portion 36 and the lid member 18 in an axial direction of the cylindrical shell 16, and bending back the wall of the lid member 18 (the wall of the fitting portion 36) along the depressions.

Each of the pair of bent-back portions 44, 46 protrudes outward from the lid member 18 in the radial direction of the cylindrical shell 16. Accordingly, the pair of lid-side fitting grooves 40, 42 are formed in the radial direction of the cylindrical shell 16. The bent-back portions 44, 46 also are formed to have semicircular cross sections.

The pair of lid-side fitting grooves 40, 42 are formed in such size and shape as to allow the flow channel pipe 14 to fit therein. In the present embodiment, each of the lid-side fitting grooves 40, 42 is formed in a semicircular shape to allow approximately half of the periphery of the flow channel pipe 14 having a cylindrical shape to fit therein.

Figure 3:
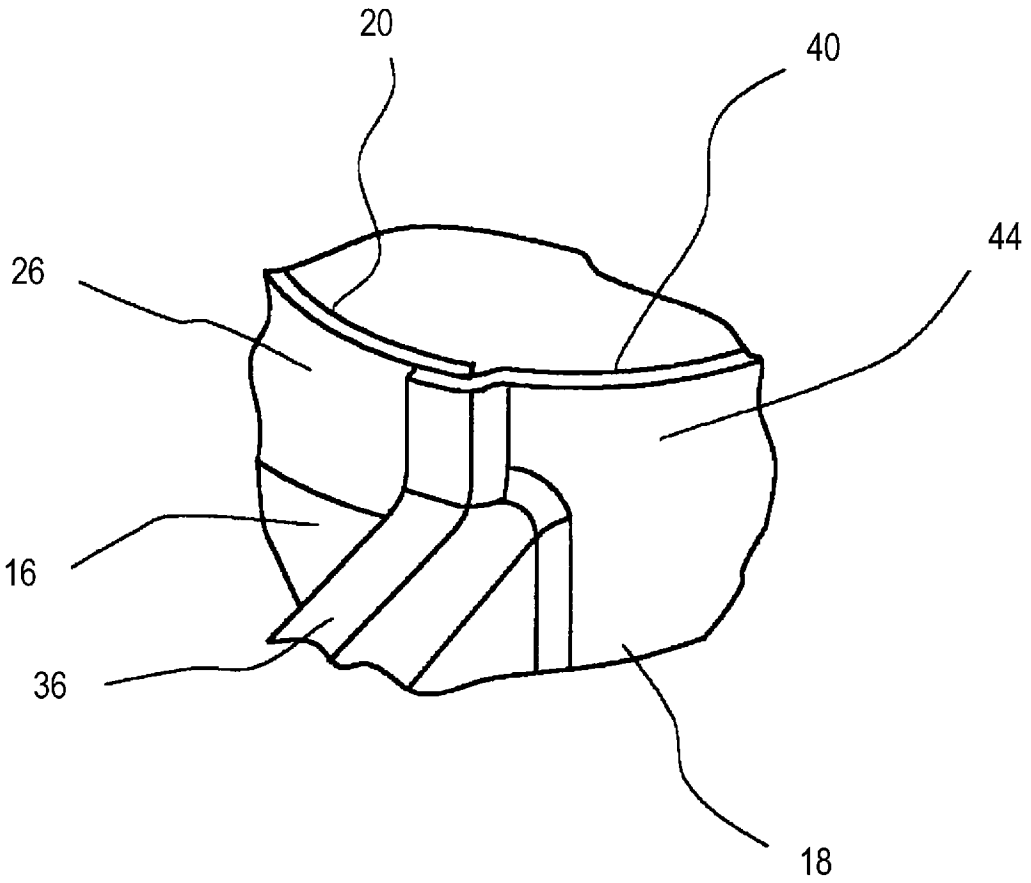
FIG. 3 is an enlarged perspective view of a bent-back portion in the embodiment.

A central portion of the lid portion 18 is raised outward in the axial direction, and parts of the bent-back portions 44, 46 of the lid member 18 are raised outward such that the fitting portion 36 overlaps the outer periphery of the cylindrical shell 16, and the bent-back portions 44, 46 of the lid member 18 overlap the bent-back portions 24, 26 of the cylindrical shell 16, as shown in FIG. 3. This allows the fitting portion 36 of the lid member 18 to fit around the outer periphery of the one end of the cylindrical shell 16.

In an assembly operation, for example, the flange member 32 is secured by welding onto the one end of the flow channel pipe 14, and the cap member 34 is fitted in the other end of the flow channel pipe 14 and secured by welding. The flow channel pipe 14 is then fitted in the pair of shell-side fitting grooves 20, 22 of the cylindrical shell 16, and the lid member 18 is placed on the one end of the cylindrical shell 16. The flow channel pipe 14 is fitted in the lid-side fitting grooves 40, 42 of the lid member 18, and the fitting portion 36 is fitted around the outer periphery of the cylindrical shell 16.

Then, the lid member 18 and the cylindrical shell 16 are welded along the fitting portion 36, and the bent-back portions 24, 26, 44, 46, and the flow channel pipe 14 are welded to be secured along, respectively, the bent-back portions 24, 26 of the cylindrical shell 16 and the bent-back portions 44, 46 of the lid member 18.

Next, a description will be provided of an operation of the exhaust gas purifying device in the present embodiment.

When the exhaust gases from the internal combustion engine 100 flow into the container 10 via the exhaust gas flow channel, the exhaust gases pass through the oxidation catalyst 6 and the DPF 8. The oxidation catalyst 6 changes, in the exhaust gases, hydrocarbons into carbon dioxide and water, and carbon monoxide by oxidation into carbon dioxide. Also, the oxidation catalyst 6 changes nitrogen monoxide from among the nitrogen oxides in the exhaust gases into nitrogen dioxide. The DPF 8 burns soot in the exhaust gases to purify the exhaust gases.

The exhaust gases that have passed through the oxidation catalyst 6 and the DPF 8 to be purified flow into the cylindrical shell 16, and flow from inside of the cylindrical shell 16 into the flow channel pipe 14 via the through holes 30. The exhaust gases that have flowed into the flow channel pipe 14 then flow out into the exhaust gas flow channel on a downstream side.

Holding the flow channel pipe 14 between the cylindrical shell 16 and the lid member 18 as such reduces a length $L_a$ in an axial direction from the flow channel pipe 14 to the lid member 18, as shown in FIG. 1, thus miniaturizing the exhaust gas purifying device.

Figure 4:
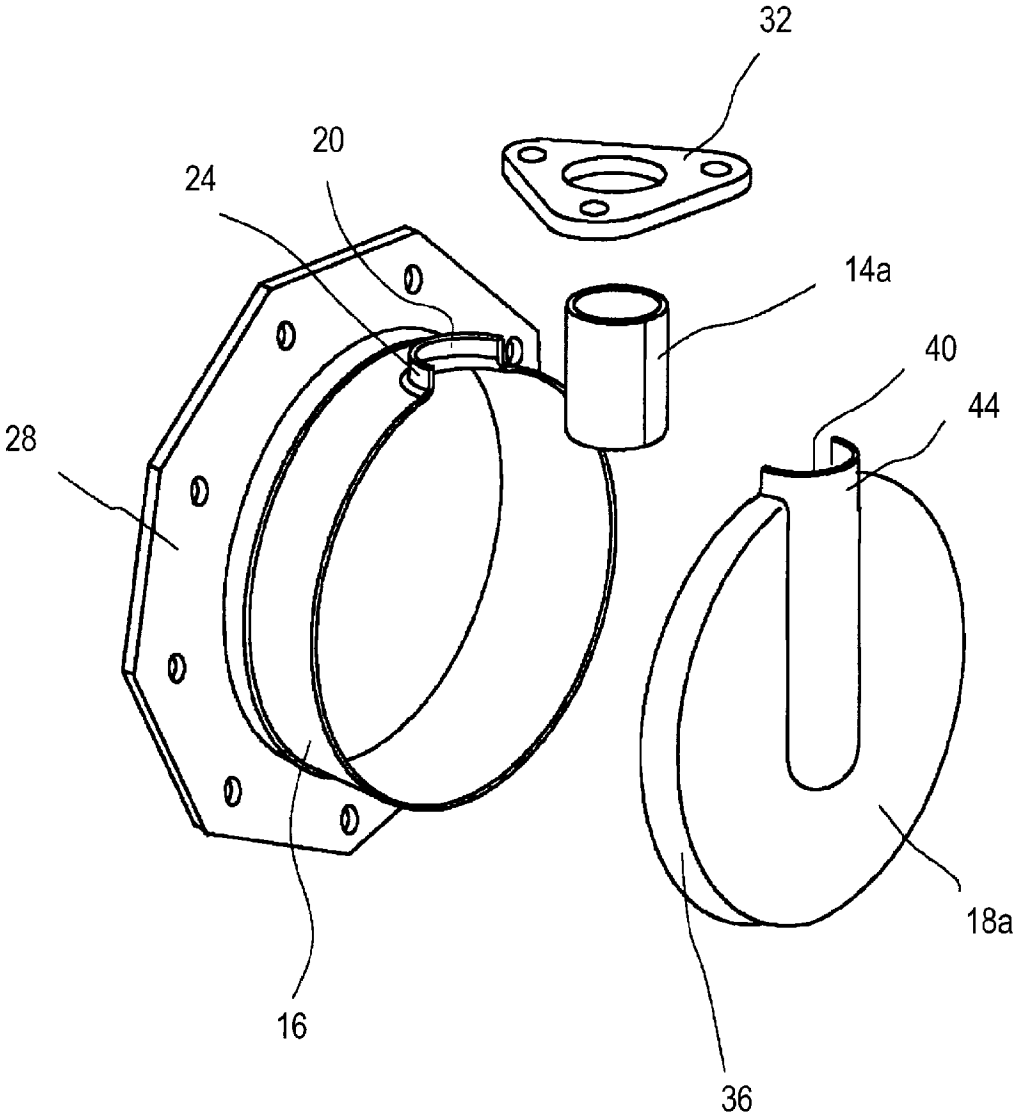
FIG. 4 is a main-part exploded perspective view of an exhaust gas purifying device in a second embodiment.
Figure 5:
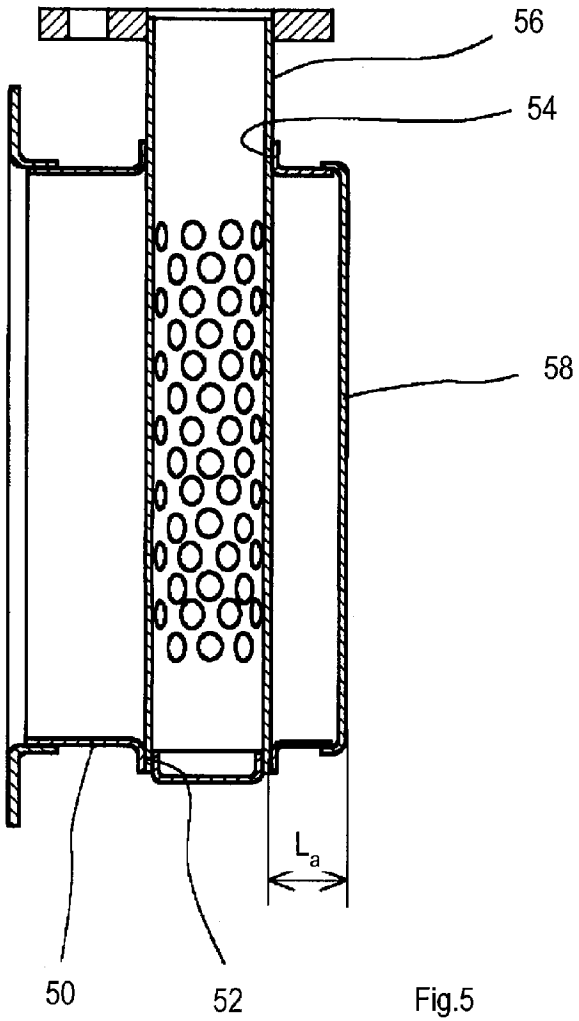
FIG. 5 is a main-part sectional view of a conventional exhaust gas purifying device.

Next, a description will be provided, with reference to FIG. 4, of a second embodiment that is different from the aforementioned embodiment.

In the exhaust gas purifying device of the present embodiment, the same members as in the exhaust gas purifying device of the first embodiment will be denoted by the same reference numbers to omit a detailed description thereof.

In the present embodiment, a cylindrical shell 16 is provided, in a part of a periphery thereof, with a shell-side fitting groove 20. This shell-side fitting groove 20 is constituted by a depression made in a wall of the cylindrical shell 16, and a bent-back portion 24 obtained by bending back the wall of the cylindrical shell 16 (a wall of a fitting portion 36) along the depression. Moreover, a flow channel pipe 14*a* of the second embodiment is shorter in length than the flow channel pipe 14 of the aforementioned embodiment, and is formed so as to have one open end of the flow channel pipe 14*a* to be located inside the cylindrical shell 16 when the flow channel pipe 14*a* is fitted in the shell-side fitting groove 20.

Furthermore, a lid member 18*a* is provided with one lid-side fitting groove 40 at a position facing the shell-side fitting groove 20. The lid member 18*a* is further provided with a bent-back portion 44 along the lid-side fitting groove 40. The lid-side fitting groove 40 is formed to be longer than the length of the flow channel pipe 14*a* to reach a vicinity of an approximate center of the lid member 18*a*.

Also in the present embodiment, holding the flow channel pipe 14*a* between the cylindrical shell 16 and the lid member 18*a* reduces the length in an axial direction from the flow channel pipe 14*a* to the lid member 18*a*, thus miniaturizing the exhaust gas purifying device.

The present invention should not at all be limited to the above-described embodiments, but can be practiced in various forms without departing from the subject matter of the present invention.

The invention claimed is:

1. An exhaust gas purifying device to be connected to an exhaust gas flow channel of an internal combustion engine to purify exhaust gases flowing in the exhaust gas flow channel, the exhaust gas purifying device comprising:

a cylindrical shell that is formed in a cylindrical shape having a pair of open ends, and in which the exhaust gases flow;

a flow channel pipe that is connected to the cylindrical shell along a radial direction of the cylindrical shell; and a lid member that closes one end of the pair of ends of the cylindrical shell, wherein the cylindrical shell has at least one shell-side fitting groove that is formed at the one end, and configured to allow the flow channel pipe to fit therein, wherein the lid member has at least one lid-side fitting groove that is formed at a position facing the at least one shell-side fitting groove, and configured to allow the flow channel pipe to fit therein, wherein the at least one shell-side fitting groove and the at least one lid-side fitting groove fit the flow channel pipe therein by holding the flow channel pipe therebetween, wherein the cylindrical shell and the lid member have bent-back portions obtained by raising the cylindrical shell and the lid member along the respective fitting grooves, and wherein a part of the bent-back portion of the lid member is raised outward such that the bent-back portion of the lid member overlaps the bent-back portion of the cylindrical shell with an outer surface of the bent-back portion of the cylindrical shell being in contact with an inner surface of the bent-back portion of the lid member.

2. The exhaust gas purifying device according to claim 1, wherein the at least one shell-side fitting groove is a pair of shell-side fitting grooves, wherein the at least one lid-side fitting groove is a pair of lid-side fitting grooves, wherein the pair of shell-side fitting grooves are formed on a same axis with each other, and wherein the pair of lid-side fitting grooves are formed on a same axis with each other.

3. The exhaust gas purifying device according to claim 2, wherein the flow channel pipe is provided in a periphery thereof with at least one through hole, and one end of the flow channel pipe is closed.

4. The exhaust gas purifying device according to claim 1, wherein the flow channel pipe is a cylindrical member having a pair of open ends, and one open end of the pair of open ends of the flow channel pipe is located inside the cylindrical shell.

5. The exhaust gas purifying device according to claim 1, wherein the at least one lid-side fitting groove is formed inwardly in the radial direction so as to extend longer than a length of the flow channel pipe.

6. The exhaust gas purifying device according to claim 5, wherein the at least one lid-side fitting groove is formed to be longer than the length of the flow channel pipe to reach a vicinity of an approximate center of the lid member.

7. The exhaust gas purifying device according to claim 1, wherein the part of the bent-back portion of the lid member is raised outward such that the bent-back portion of the lid member overlaps the bent-back portion of the cylindrical shell with the flow channel pipe being fitted in the at least one shell-side fitting groove and the at least one lid-side fitting groove.

* * * * *